US010138883B2

(12) United States Patent
Wu

(10) Patent No.: US 10,138,883 B2
(45) Date of Patent: Nov. 27, 2018

(54) AIR PUMP INCLUDING AIR RESERVOIR INCLUDING OUTLET PORT ADAPTED TO BE OPENED/CLOSED AUTOMATICALLY

(71) Applicant: Scott Wu, Taichung (TW)

(72) Inventor: Scott Wu, Taichung (TW)

( * ) Notice: Subject to any disclaimer, the term of this patent is extended or adjusted under 35 U.S.C. 154(b) by 4 days.

(21) Appl. No.: 15/461,778

(22) Filed: Mar. 17, 2017

(65) Prior Publication Data

US 2018/0223833 A1 Aug. 9, 2018

(30) Foreign Application Priority Data

Feb. 8, 2017 (TW) ..... 106104167 A

(51) Int. Cl.

| | |
|---|---|
| ***F04B 49/22*** | (2006.01) |
| ***F04B 41/02*** | (2006.01) |
| ***F04B 33/00*** | (2006.01) |
| ***F04B 53/10*** | (2006.01) |
| *F04B 53/16* | (2006.01) |

(52) U.S. Cl.

CPC ..... *F04B 49/22* (2013.01); *F04B 33/005* (2013.01); *F04B 41/02* (2013.01); *F04B 53/10* (2013.01); *F04B 53/16* (2013.01); *Y10T 137/86035* (2015.04)

(58) Field of Classification Search

CPC ..... F04B 49/22; F04B 33/005; F04B 41/02; F04B 53/10; Y10T 137/86035

See application file for complete search history.

(56) References Cited

U.S. PATENT DOCUMENTS

| | | | | |
|---|---|---|---|---|
| 6,257,849 | B1 * | 7/2001 | Wu | F04B 33/005 417/238 |
| 6,893,232 | B2 * | 5/2005 | Wu | F04B 33/005 417/547 |
| 8,109,745 | B2 * | 2/2012 | Wu | F04B 33/005 417/234 |
| 8,721,296 | B1 * | 5/2014 | Wang | F04B 33/005 137/565.15 |
| 8,905,055 | B2 * | 12/2014 | Greene, III | F16K 17/042 137/12 |
| 2010/0096028 | A1 * | 4/2010 | Qiu | F16K 15/026 137/538 |

(Continued)

FOREIGN PATENT DOCUMENTS

TW I542786 B 7/2016

*Primary Examiner* — Craig Schneider
*Assistant Examiner* — Kevin Barss
(74) *Attorney, Agent, or Firm* — Alan D. Kamrath; Kamrath IP Lawfirm, P.A.

(57) ABSTRACT

An air pump includes an air reservoir, a discharge passage, a valve, and a pusher. The discharge passage includes a first section and a second section wider than the first section. The valve, disposed in a first position, includes first and second seal ends respectively disposed in the first and second sections. The valve, disposed in a second position, includes the first seal end disengaging from the first section and includes the second seal end disposed in the second section. The second seal end has a greater cross-sectional area than the first seal end. The pusher is movably retained in the air reservoir and is movable between a first position spaced from the valve and a second position abutting the valve. The valve is disposed in the second position when the pusher is disposed in the second position.

16 Claims, 4 Drawing Sheets

(56) References Cited

U.S. PATENT DOCUMENTS

| | | | | |
|---|---|---|---|---|
| 2014/0193276 | A1* | 7/2014 | Hanson | F04B 33/005 417/53 |
| 2015/0211500 | A1* | 7/2015 | Kumazawa | F04B 1/182 137/471 |

* cited by examiner

AIR PUMP INCLUDING AIR RESERVOIR INCLUDING OUTLET PORT ADAPTED TO BE OPENED/CLOSED AUTOMATICALLY

BACKGROUND OF THE INVENTION

1. Field of the Invention

The present invention relates to an air pump and, particularly, to an air pump including an air reservoir including an outlet port adapted to be opened/closed automatically.

2. Description of the Related Art

TW Pat. No. 1542786 discloses an air pump for tubeless tires. The air pump includes a pumping system and an air reservoir fluidly connected to the pumping system to store air generated by the pumping system. The air pump further includes a closure device for selectively discharging air out of the air reservoir. However, the closure device is manually controlled.

The present invention is, therefore, intended to obviate or at least alleviate the problems encountered in the prior art.

SUMMARY OF THE INVENTION

According to the present invention, an air pump includes a pumping system, an air reservoir, a discharge passage, a valve, and a pusher. The pumping system includes a cylinder. The air reservoir is connected to the cylinder and includes an inlet port for receiving air generated by the pumping system and an outlet port. The discharge passage is connected to the outlet port and extends axially. The discharge passage includes a first section and a second section wider than the first section. The valve is movable in the discharge passage between a first position and a second position. The valve, disposed in the first position, includes a first seal end disposed in the first section and abutting a periphery thereof and includes a second seal end disposed in the second section and abutting a periphery thereof. The valve, disposed in the second position, includes the first seal end disengaging from the first section and not abutting the periphery thereof and includes the second seal end disposed in the second section and abutting the periphery thereof. The first seal end has a first cross-sectional area, and the second seal end has a second cross-sectional area which is greater than the first cross-sectional area. The pusher is movably retained in the air reservoir and is movable between a first position spaced from the valve and a second position abutting the valve. The valve is disposed in the second position when the pusher is disposed in the second position.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the public generally, and especially the scientists, engineers and practitioners in the art who are not familiar with patent or legal terms or phraseology, to determine quickly from a cursory inspection the nature and essence of the technical disclosure. The abstract is neither intended to define the invention, which is measured by the claims, nor is it intended to be limiting as to the scope of the invention in any way.

It is an objective of the present invention to provide an air pump including a pumping system and an air reservoir fluidly connected to the pumping system and including an automatic opening/closing outlet port.

Other objectives, advantages, and new features of the present invention will become apparent from the following detailed description of the invention when considered in conjunction with the accompanied drawings.

DETAILED DESCRIPTION OF THE INVENTION

Figure 1:
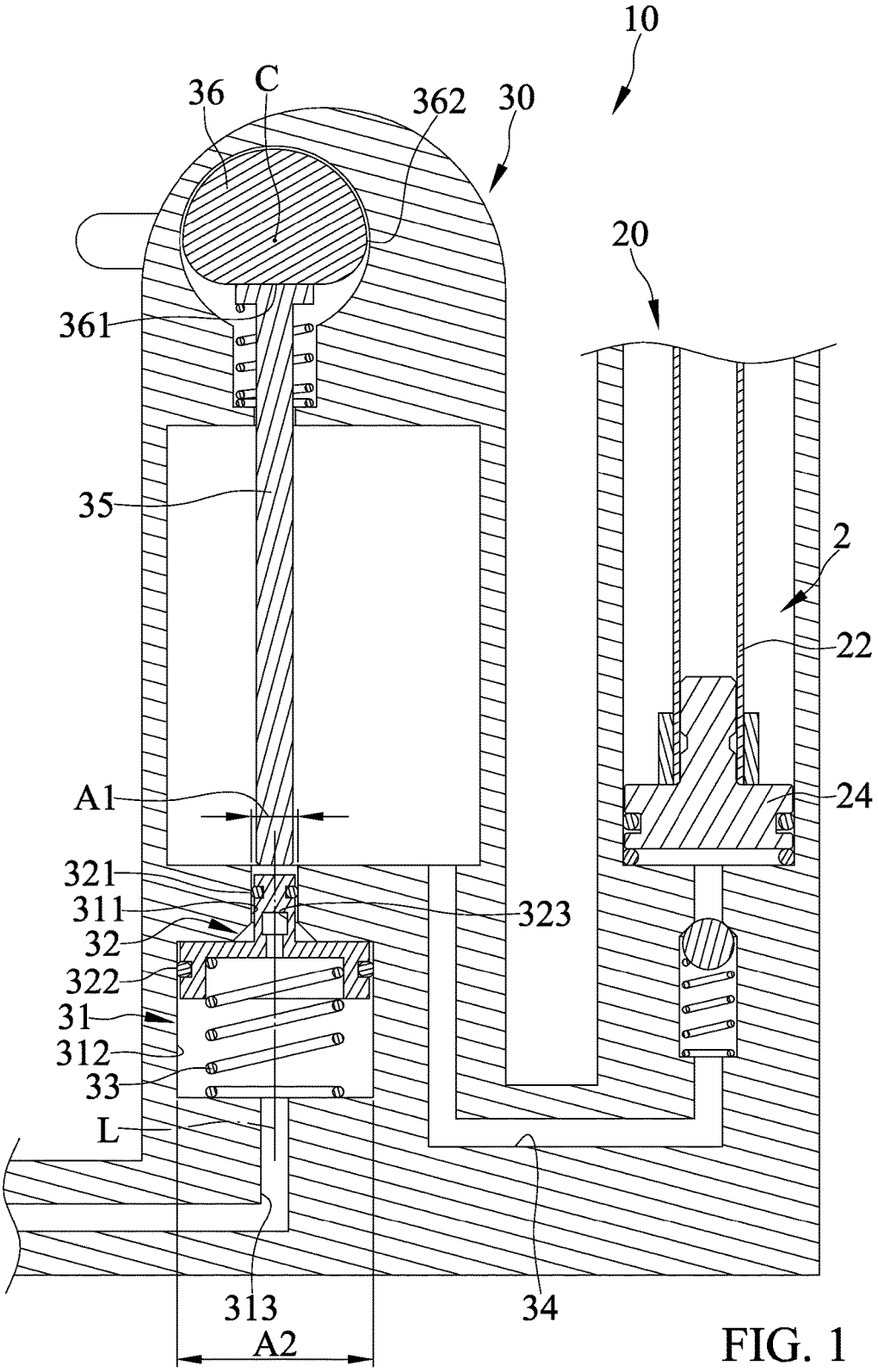
FIG. 1 is a partial, cross-sectional view of an air pump in accordance with the present invention.

An air pump 10 includes a pumping system 2, an air reservoir 30, a discharge passage 31, a valve 32, and a pusher 35.

The pumping system 2 includes a cylinder 20, a plunger 22, and a piston 24 coupled to an end of the plunger 22. The piston 24 is disposed in the cylinder 20. The piston 24 is reciprocally movable in the cylinder 20 and is operated by the plunger 22.

The air reservoir 30 is connected to the cylinder 20 and includes an inlet port 301 for receiving air generated by the pumping system 2 and an outlet port 302.

The discharge passage 31 is connected to the outlet port 302 and extends axially. The discharge passage 31 extends axially and longitudinally along an axis L. The discharge passage 31 includes a first section 311 and a second section 312 and extends from the first section 311 to the second section 312 along the axis L. The second section 312 is wider than the first section 311 in a width direction of the discharge passage 31, which is perpendicular to the axis L.

The valve 32 is movable in the discharge passage 31 between a first position and a second position. The valve 32, disposed in the first position, includes a first seal end 321 disposed in the first section 311 and abutting a periphery thereof and includes a second seal end 322 disposed in the second section 312 and abutting a periphery thereof. The valve 32, disposed in the second position, includes the first seal end 321 disengaging from the first section 311 and not abutting the periphery thereof and includes the second seal end 322 disposed in the second section 312 and abutting the periphery thereof. The first and second seal ends 321 and 322 respectively have first and second cross-sectional areas A1 and A2. The ratio of the second cross-sectional area A2 to the first cross-sectional area A1 is at least 2 to 1. It is also contemplated that the ratio of second cross-sectional area A2 to the first cross-sectional area A1 is at least 10 to 1. The valve 32 has a middle portion extending between the first seal end 321 and the second seal end 322. The valve 32 includes a hole 323 extending through the middle portion and defining two open ends.

A biasing member 33 acts on the valve 32 in a direction towards the outlet port 302. The discharge passage 31 has an outlet end 313 defining an opening on a wall of the second section 312. The second section 312 is wider than the opening. The biasing member 33 includes an end abutting the valve 32 and another end abutting the wall. The outlet end 313 defines an air exit of the air pump, such that an object to be inflated is connected to the exit end. The exit end allows air to flow out of the air pump 10.

A passage 34 has a first distal end connected to the cylinder 20 and a second distal end connected to the inlet port of the air reservoir 30. The passage 34 includes a one-way seal device disposed therein. The one-way seal device prevents air flowing in the passage 34 reversely into the cylinder 20. The one way seal device includes a block and a biasing member biasing the block.

The pusher 35 is movably retained in the air reservoir 30 and is movable between a first position spaced from the valve 32 and a second position abutting the valve 32. The valve 32 is disposed in the second position when the pusher 35 is disposed in the second position. Further, a biasing member acts on the pusher 35. The biasing member includes one end abutting a wall of the compartment and another end abutting the pusher 35.

The air reservoir 30 includes a compartment receiving a control 36. The air reservoir 30 includes a chamber in which air is stored. The chamber and the compartment are connected to one another. The control 36 acts on the pusher 35 and is operable to one position in which the pusher 35 is urged to the first position and another position in which the pusher 35 is urged to the second position. The control 36 is pivotally coupled to the air reservoir 30 about a pivotal point C and is in a form of a cam. The cam includes a flat periphery and a curved periphery. The flat periphery is disposed at a closer distance to the pivotal point than the curved periphery. The control 36 includes first and second abutting portions 361 and 362 for urging the pusher 35 between the first and second positions. A distance between the first abutting portion 361 and the pivotal point C is smaller than a distance between the second abutting portion 362 and the pivotal point C. The pusher 35 is urged by the first abutting portion 361 when disposed in the first position. The pusher 35 is urged by the second abutting portion 362 when disposed in the second position. Therefore, the flat periphery is the first abutting portion 361, and the curved periphery is the second abutting portion 362 respectively.

Figure 2:
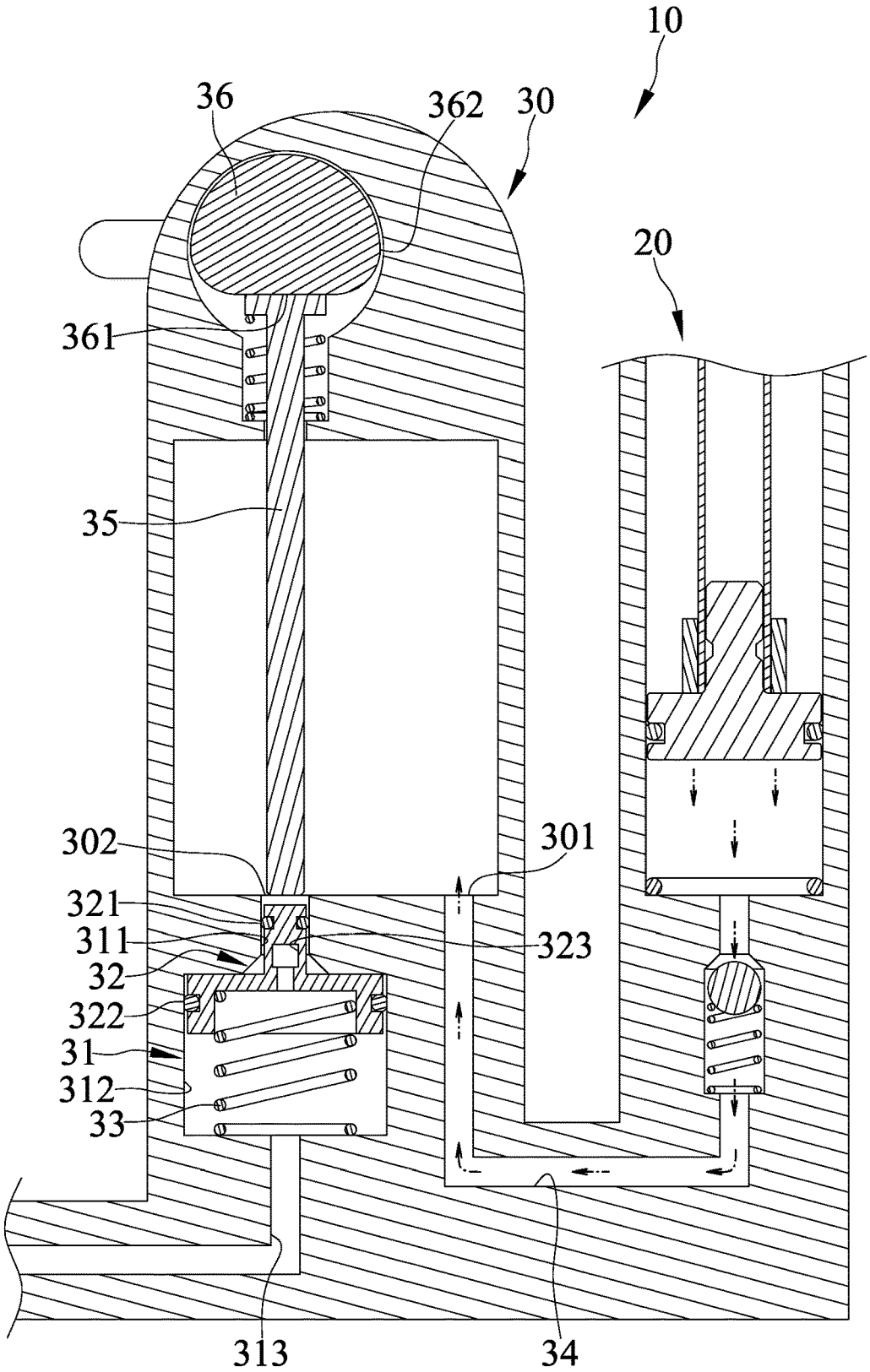
FIG. 2 is a partial, cross-sectional view showing the air pump including a pumping system generating air and which is delivered to and is stored within an air reservoir, with a pusher in a first position.
Figure 3:
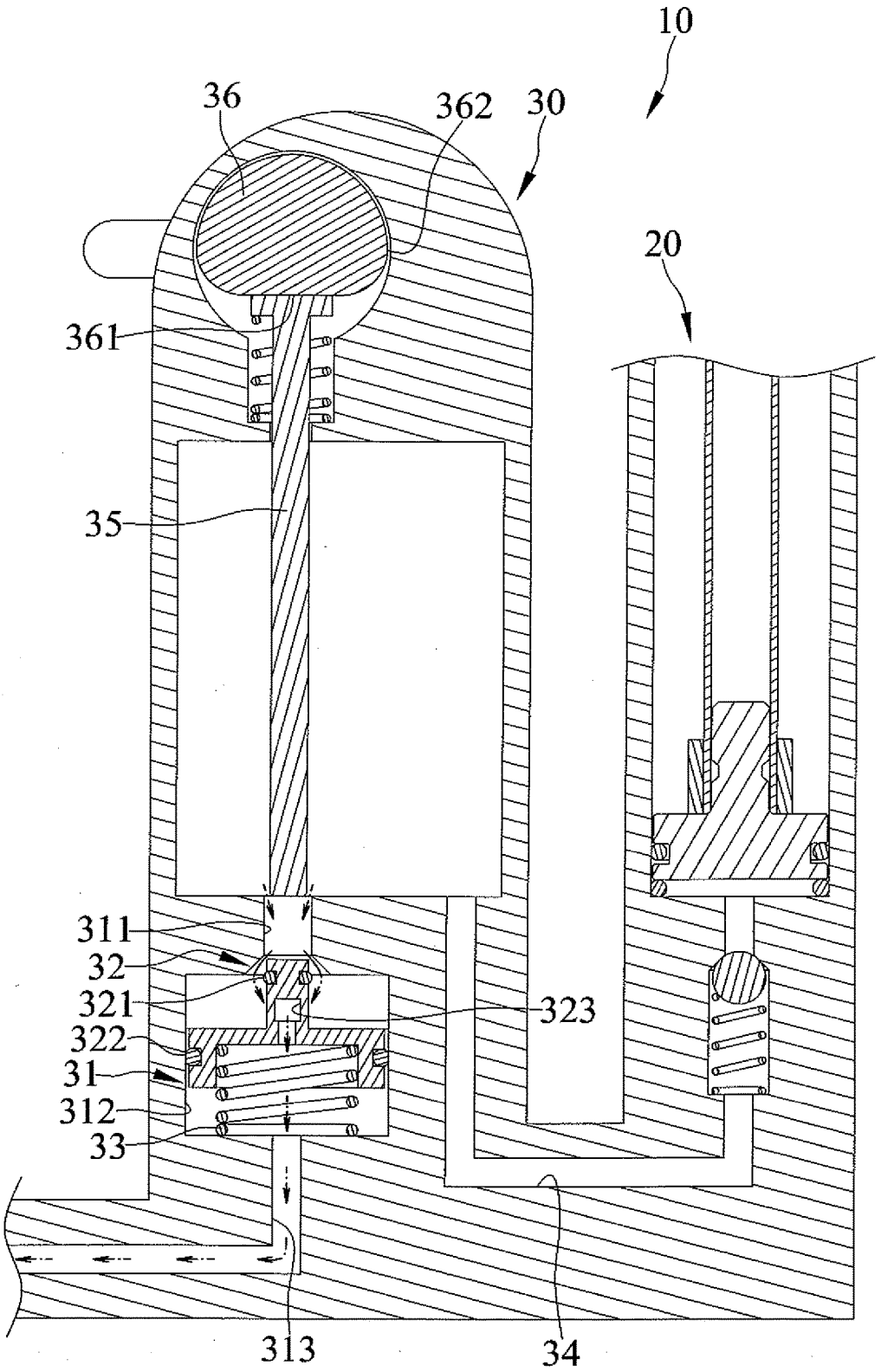
FIG. 3 is a partial, cross-sectional view showing the pusher disposed in the first position as well as air discharging out of the air reservoir and the outlet port of the air reservoir in an open position.
Figure 4:
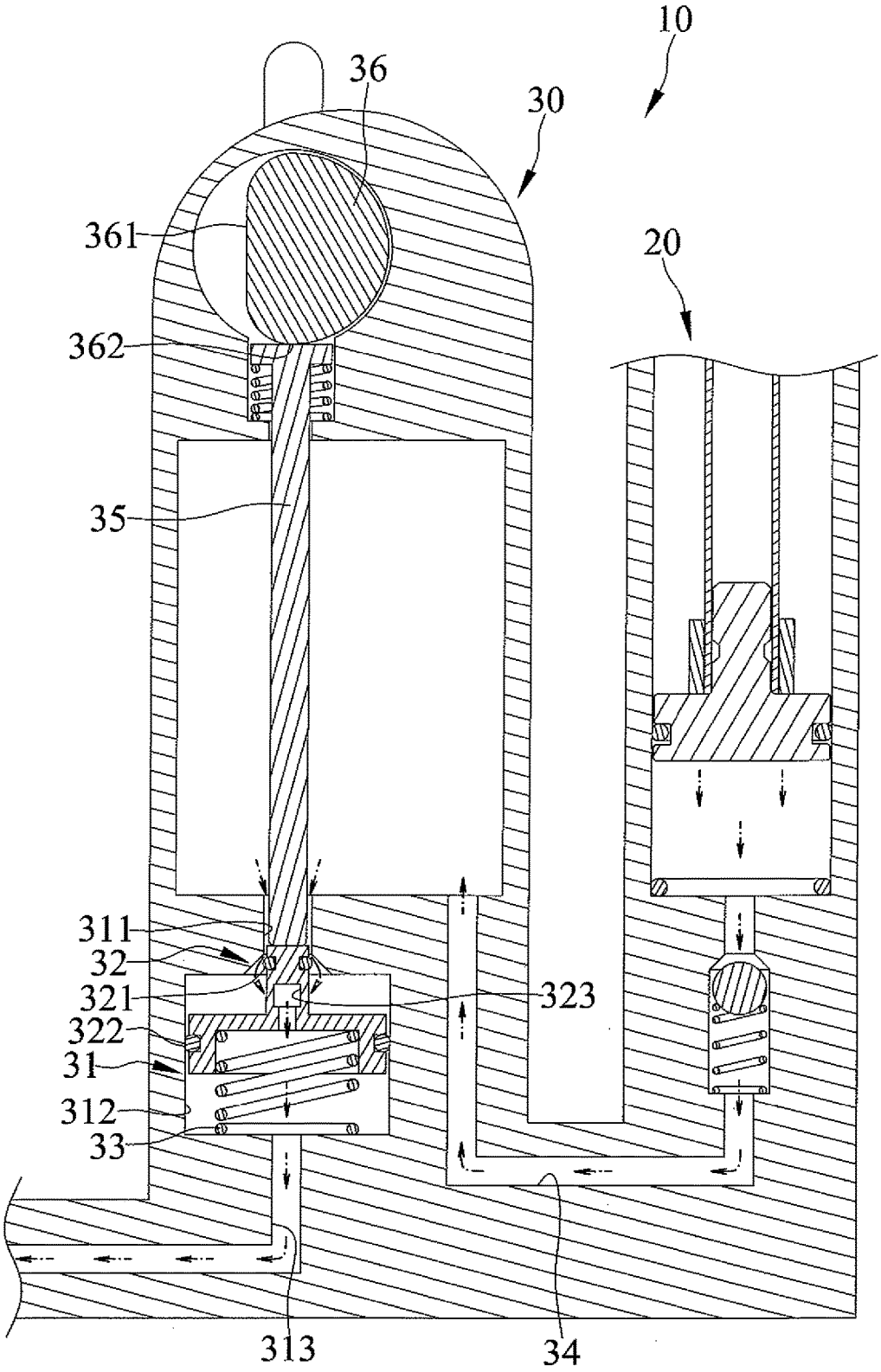
FIG. 4 is a partial, cross-sectional view showing the pumping system generating air and which flows in and out of the air reservoir and to an outlet of the air pump, with the pusher in a second position.

As shown in FIG. 2, air is pumped into the air reservoir 30 via the passage 34 upon operation of the pumping system. In a configuration that the pusher 35 is disposed in the first position, the pressure inside the air reservoir 30 increases as the pumping system pumps air into the air reservoir 30. When the pressure is not high enough, air is unable to overwhelm the biasing member 33 to urge the valve 32 from the first position to the second position. The valve 32, disposed in the first position, stops air in the air reservoir 30 flowing out of the outlet port 302. As shown in FIG. 3, when the air reservoir 30 stores sufficient volumes of air and the pressure inside is high enough, air can supply enough force to urge the valve 32 to the second position. The valve 32, disposed in the second position, allows air in the air reservoir 30 to flow out of the outlet port 302 and into the discharge passage 31. Furthermore, when the first seal end 321 disengages from the first section 311, a gap is created between the first seal end 321 and the periphery of the second section 312. The hole 323 includes one open end connected to the gap and another open end connected to the second section 312. Therefore, air in the air reservoir 30 flows out of the outlet port 302, and into the discharge passage 31 through the gap and the open ends of the hole. Furthermore, as the volumes of air inside the air reservoir 30 decrease, the valve 32 will start moving from the second position to the first position.

In a configuration that the pusher 35 is disposed in the second position, air flows through the air reservoir 30 and into the exit end upon operation of the pumping system. In this configuration, the air reservoir 30 does not store air.

In view of the forgoing, the outlet port 302 of the air reservoir 30 can be opened/closed automatically by the valve 32 when the pusher 35 is disposed in the first position. Furthermore, air flows out of the air pump when the pusher 35 is disposed in the second position.

The foregoing is merely illustrative of the principles of this invention, and various modifications can be made by those skilled in the art without departing from the scope and spirit of the invention.

What is claimed is:

1. An air pump comprising:

a pumping system including a cylinder;

an air reservoir connected to the cylinder and including an inlet port for receiving air generated by the pumping system and an outlet port;

a discharge passage connected to the outlet port and extending axially, wherein the discharge passage includes a first section and a second section wider than the first section;

a valve being movable in the discharge passage between a first position and a second position, wherein the valve, disposed in the first position, includes a first seal end disposed in the first section and abutting a periphery thereof and includes a second seal end disposed in the second section and abutting a periphery thereof, wherein the valve, disposed in the second position, includes the first seal end disengaging from the first section and not abutting the periphery thereof and includes the second seal end disposed in the second section and abutting the periphery thereof, wherein the first seal end has a first cross-sectional area and the second seal end has a second cross-sectional area which is greater than the first cross-sectional area; and a pusher movably retained in the air reservoir and being movable between a first position spaced from the valve and a second position abutting the valve, wherein the valve is disposed in the second position when the pusher is disposed in the second position.

2. The air pump as claimed in claim 1, wherein the ratio of the second cross-sectional area to the first cross-sectional area is at least 2 to 1.

3. The air pump as claimed in claim 2, wherein the ratio of the second cross-sectional area to the first cross-sectional area is at least 10 to 1.

4. The air pump as claimed in claim 3 further comprising a control acting on the pusher and being operable to one position in which the pusher is urged to the first position and another position in which the pusher is urged to the second position.

5. The air pump as claimed in claim 4, wherein the control is pivotally coupled to the air reservoir about a pivotal point and is in a form of a cam.

6. The air pump as claimed in claim 5, wherein the control includes first and second abutting portions for urging the pusher between the first and second positions, wherein a distance between the first abutting portion and the pivotal point is smaller than a distance between the second abutting portion and the pivotal point, wherein the pusher is urged by the first abutting portion when disposed in the first position, and wherein the pusher is urged by the second abutting portion when disposed in the second position.

7. The air pump as claimed in claim 6, wherein the valve has a middle portion extending between the first seal end and the second seal end, and wherein the valve includes a hole extending through the middle portion and defining two open ends.

8. The air pump as claimed in claim 7 further comprising a biasing member abutting the valve in a direction towards the outlet port, wherein the discharge passage has an outlet end defining an opening on a wall of the second section, wherein the second section is wider than the opening, and wherein the biasing member includes an end abutting the valve and another end abutting the wall.

9. The air pump as claimed in claim 8 further comprising a passage having a first distal end connected to the cylinder and a second distal end connected to the inlet port of the air reservoir.

10. The air pump as claimed in claim 2 further comprising a control acting on the pusher and being operable to one position in which the pusher is urged to the first position and another position in which the pusher is urged to the second position.

11. The air pump as claimed in claim 10, wherein the control is pivotally coupled to the air reservoir about a pivotal point and is in a form of a cam.

12. The air pump as claimed in claim 11, wherein the control includes first and second abutting portions for urging the pusher between the first and second positions, wherein a distance between the first abutting portion and the pivotal point is smaller than a distance between the second abutting portion and the pivotal point, wherein the pusher is urged by the first abutting portion when disposed in the first position, and wherein the pusher is urged by the second abutting portion when disposed in the second position.

13. The air pump as claimed in claim 12, wherein the valve has a middle portion extending between the first seal end and the second seal end, and wherein the valve includes a hole extending through the middle portion and defining two open ends.

14. The air pump as claimed in claim 13 further comprising a biasing member abutting the valve in a direction towards the outlet port, wherein the discharge passage has an outlet end defining an opening on a wall of the second section, wherein the second section is wider than the opening, and wherein the biasing member includes an end abutting the valve and another end abutting the wall.

15. The air pump as claimed in claim 14 further comprising a passage having a first distal end connected to the cylinder and a second distal end connected to the inlet port of the air reservoir.

16. The air pump as claimed in claim 1, wherein the valve has a middle portion extending between the first seal end and the second seal end, and wherein the valve includes a hole extending through the middle portion and defining two open ends.

* * * * *